United States Patent [19]

Sanko

[11] 4,157,151

[45] Jun. 5, 1979

[54] CAP FINISHING MACHINE

[75] Inventor: John R. Sanko, Altoona, Pa.

[73] Assignee: Paris Manufacturing Company, Inc., Brockway, Pa.

[21] Appl. No.: 914,150

[22] Filed: Jun. 9, 1978

[51] Int. Cl.[2] ..... A42C 1/04

[52] U.S. Cl. ..... 223/13; 223/15; 223/26

[58] Field of Search ..... 38/13, 15, 26; 223/24, 223/25, 26, 51, 70, 73, 13, 15; 28/124

[56] References Cited

U.S. PATENT DOCUMENTS

| | | | |
|---|---|---|---|
| 388,497 | 8/1888 | McLoughlin | 223/51 X |
| 1,492,083 | 4/1924 | Pegues | 223/51 |
| 1,580,045 | 4/1926 | Johnson | 223/24 |
| 2,935,237 | 5/1960 | Seiler | 223/25 |
| 3,883,051 | 5/1975 | Bailey | 223/51 |
| 3,934,766 | 1/1976 | Bailey | 223/51 X |

FOREIGN PATENT DOCUMENTS

| | | | |
|---|---|---|---|
| 716107 | 12/1931 | France | 223/26 |

*Primary Examiner*—Louis Rimrodt

*Attorney, Agent, or Firm*—Parmelee, Miller, Welsh & Kratz

[57] ABSTRACT

What may be termed a low-boy machine is provided with a side-positioned air-supplying blowing chamber, an air heating and upwardly and directing chamber-defining base part, a centrally disposed upright support post or column, an upright steam burst and heat-applying pipe assembly, an upper platform frame on the column that carries cap-finishing means, and a non-permeable bag positioned to extend upwardly between the base part and the upper frame to define a fluid-directing and mixing chamber for supplying steam and hot air to the cap-finishing means. The cap-finishing means has a pair of perforated cap-receiving and stretching parts through which steam and heated air is supplied to the inside of a fabric cap to be finished. The pair of parts have means for relatively moving them towards and away from each other to release and stretch a cap that is positioned thereon.

5 Claims, 8 Drawing Figures

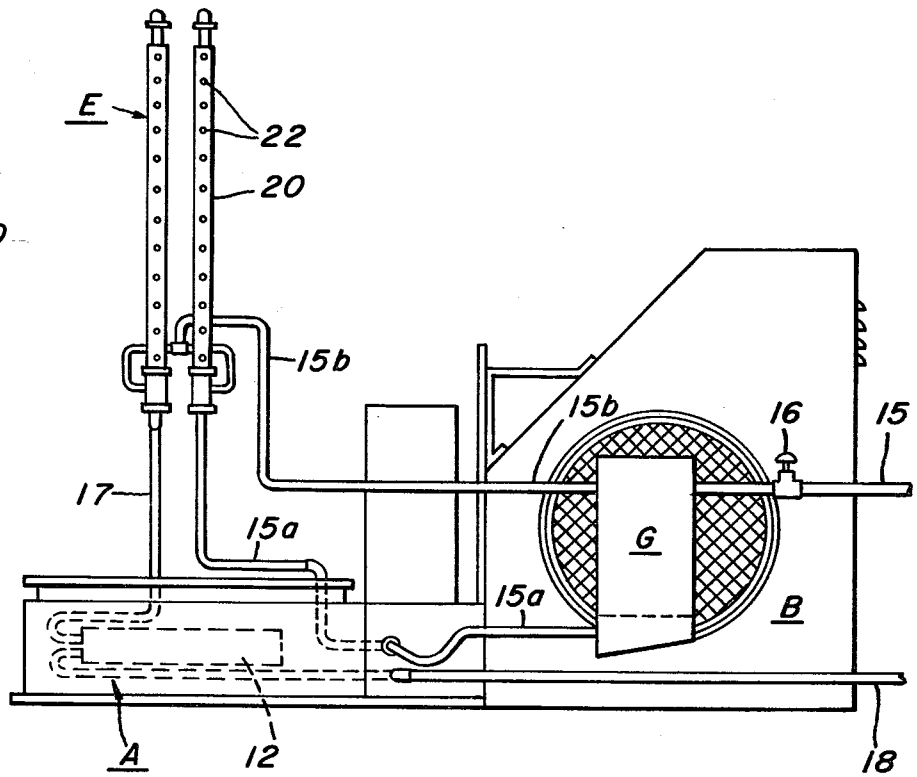
FIG. 1.
FIG. 2A.
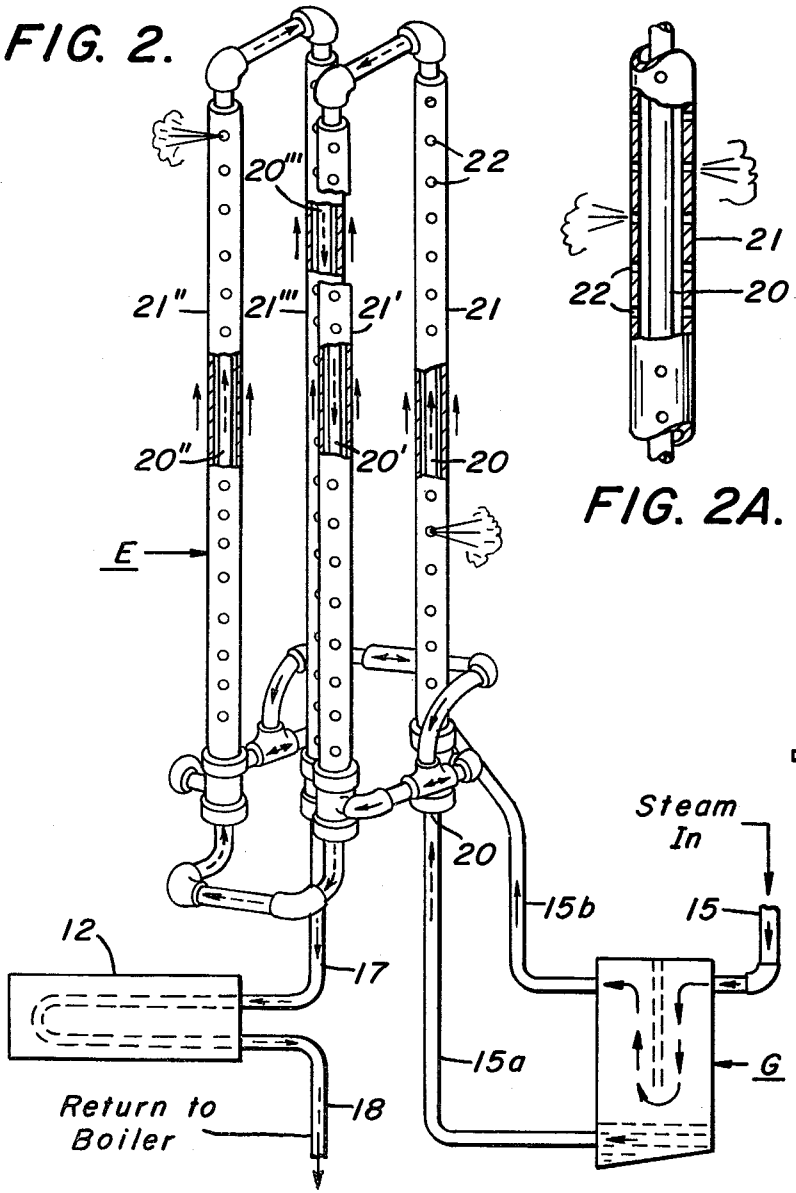
FIG. 2.

FIG. 7.
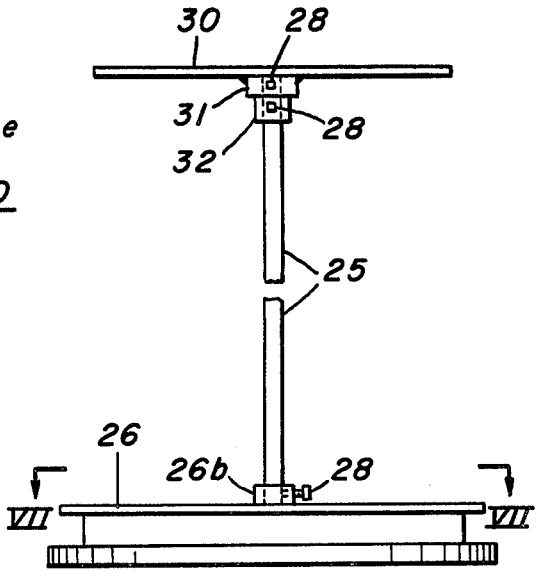
FIG. 6.
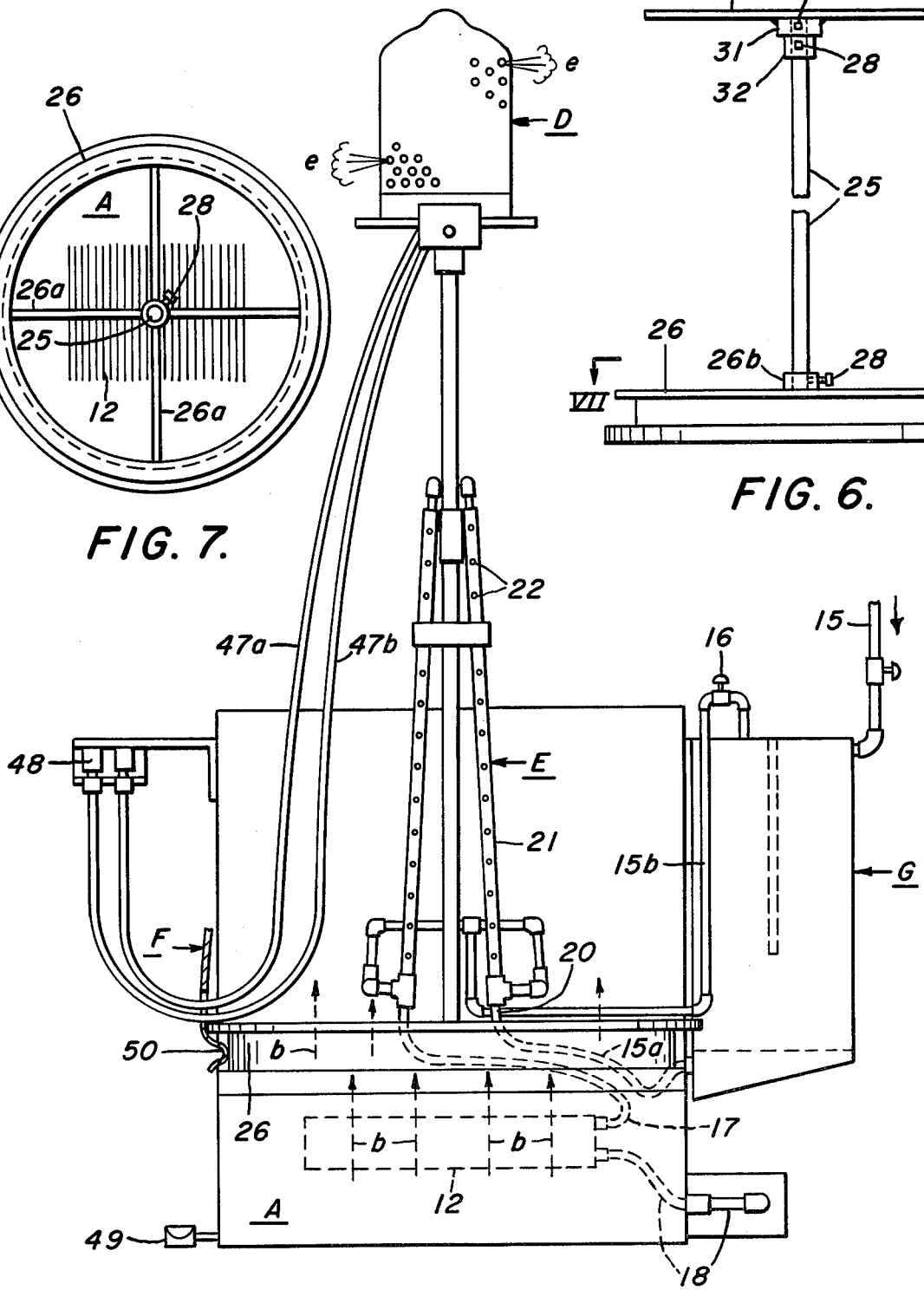
FIG. 3.

CAP FINISHING MACHINE

BACKGROUND OF THE INVENTION

1. Field of the Invention

This invention relates to a semi-portable machine or apparatus for finishing or conditioning a cap-like article of fabric material which has a pair of upper cap-receiving parts that define an expandable cap-receiving form that enables heated fluid to be applied within the cap to finish it. An important phase of the invention deals with the employment of an upright, fluid mixing and conditioning chamber which supplies heated fluid through a pair of mounting parts to a cap positioned thereon and enables the utilization of hot-air and periodic direct steam bursts for finishing the 2. Description of the Prior Art Machines have heretofore been provided for initially finishing and conditioning clothing, such as shirts, dresses, coats and sweaters, as well as for reshaping used garments for re-use after they have been cleaned. However, it is believed that no production line type of machine or apparatus has heretofore been devised or made available for finishing or conditioning fabric-like caps, such as used to cover the head of a wearer. There have heretofore been machines for supplying heated air, as well as moisturizing steam within garments and, in this connection, my copending application Ser. No. 877,947, filed Feb. 15, 1978, is representative of a machine for supplying finishing fluid in an improved manner to an article of clothing through a permeable bag on which the clothing is positioned. Due to a return of popularity of caps, not only for sporting usage but also for dress usage, a need has arisen for a production line type of machine which will quickly and in an improved manner finish them.

SUMMARY OF THE INVENTION

An object of the present invention has been to meet the above need by providing a practical and efficient cap-finishing machine and one that embodies improved operating characteristics that have been attained in apparatus developed by me for garments.

Another object has been to devise a cap-finishing machine in which hot air may be applied continuously during a finishing operation, steam may be indirectly utilized in heating the air, and finally in which steam bursts may be directly mixed with the hot air before it is applied to the cap.

A further object of the invention has been to devise a low profile machine for a production line type of finishing caps and the like.

These and other objects will appear to those skilled in the art from the illustrated embodiment and the claims.

BRIEF DESCRIPTION OF THE DRAWINGS

FIG. 1 is a side view in elevation illustrating a machine embodying the invention but with its upper cap-receiving and mounting structure omitted;

FIG. 2 is a slightly enlarged schematic perspective view in elevation, particularly illustrating an upright, steam heat, and direct steam-burst-supplying tubular assembly or system that it utilized in the apparatus of FIG. 1;

FIG. 2A is a greatly enlarged fragmental view taken through a representative pair of inner and outer or dual tubular elements of four-part steam assembly of FIG. 2, particularly showing outflow orifices or openings in the wall of an outer tube of each pair for directly supplying steam in bursts, and showing an inner tube along which hot steam moves or is continuously circulated to indirectly supply heat to a chamber defined between the inner and outer tubes of each pair;

FIG. 3 is an enlarged end view in elevation of the apparatus of FIG. 1, further illustrating the construction, and showing upper, cap-receiving parts;

FIG. 6 is an upright view on a reduced scale, particularly illustrating inside or basic support structure for the machine;

Figures 4, 5:
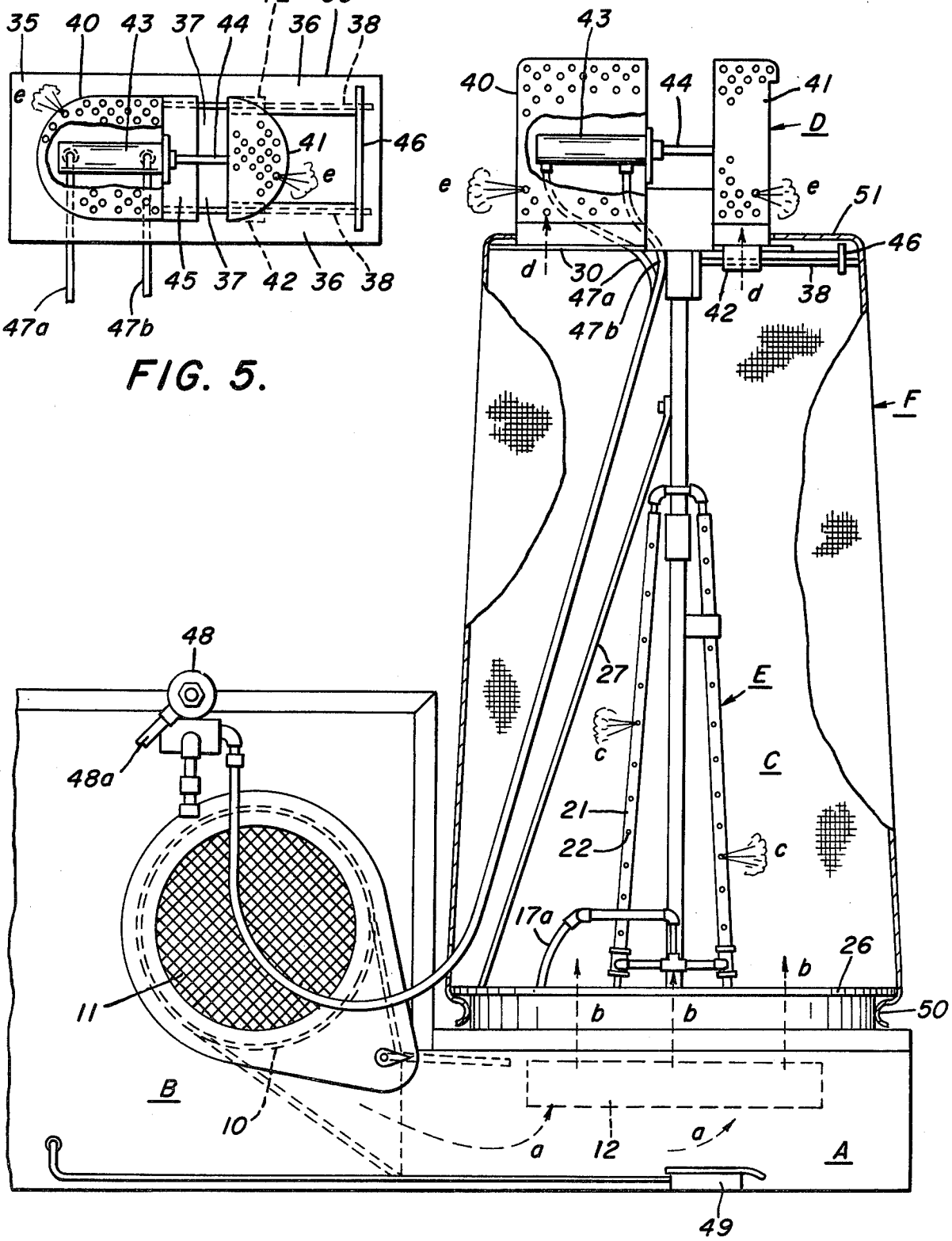
FIG. 4 is a side view in elevation, taken from an opposite side of the machine from FIG. 1, and particularly showing the positioning and utilization of a fluid-mixing chamber, as well as details of cap-receiving and expanding mechanism that is carried on an upper end of the central column or post of the machine.
FIG. 5 is a top plan view that is partially broken away, on the scale of FIG. 4, and particularly showing further details of the construction of the upper cap-receiving mechanism of the machine.

And, FIG. 7 is a horizontal section, taken along the line VII—VII of FIG. 6.

DESCRIPTION OF THE PREFERRED EMBODIMENT

Referring particularly to FIGS. 1, 3 and 4, a cap-finishing machine is shown which has a stand, base or pedestal part A that defines an air-heating and supplying chamber. Also shown, are a side-positioned, ambient air pick-up and blowing plenum chamber-defining housing B for supplying air to base part A, an upright heating, fluid-receiving-mixing and dispensing chamber C that is positioned above the base part A to receive hot air therefrom, a cap-receiving positioning, expanding and stretching pair of parts of an overhead forming means of assembly D, an upright steam heat and steam-supplying tubular assembly E that is positioned between the part A and the assembly D, and a non-permeable mixing chamber defining fabric-like, sealing-off bag F that is adapted to enclose spacing between an upper portion of the base part A and the frame of the overhead assembly D. Ambient air is drawn into the blower chamber of the housing B by motor-driven blower 10 through open grillwork 11 and is then introduced as a positive flow, as indicated by arrows a, into an air heating chamber of the base or pedestal part A through a connecting passageway therebetween, see arrow a of FIG. 4.

The ambient air, as thus positively introduced into the part A, passes upwardly as heated air from open or through-extending vertical passageways defined by the fins and tubing of a heat exchanger 12, and upwardly out of an open upper end of the base part A, as defined by a surmounting flange or rim part 26, into the mixing chamber C (see arrows a and b). The non-permeable bag F, at its lower end, is provided with suitable means for tightly fitting it within an outer groove or channel of circular, surmounting flange or ring part 26, as by means of a flexible or drawstring portion 50 (see FIG. 4).

The upright, chamber-defining bag F has an upper selvage edge portion which is adapted to fit-over an upper support frame or table 30 and to seal-off the upper reaches of the table 30 by providing a close fit about a pair of right and left-hand, cap-receiving, perforated, forming parts 40, 41. One portion 51 of the upper edge of the bag F is adapted, as being flexible, to follow outwardly expanding and inwardly contracting movement of one part 41 of the pair parts of the assembly D.

As shown in FIGS. 3, 4 and 5, the forming parts 40 and 41 may be of perforated metal construction of somewhat rounded or cylindrical, hollow shape to directly receive the inside of a cap to rest on their perforated top and side wall portions. The part 41 is constructed for longitudinal sliding movement on a horizontal plane with respect to the part 40 to expand the relationship therebetween and stretch a cap that is positioned thereon for refinishing. Hot treating fluid (air and/or steam) flows upwardly from the chamber C (see arrows d of FIG. 4) into open lower ends of the pair of forming parts 40 and 41 and out through orifices in their walls (see the arrows e) to the inside of a cap positioned thereon.

Referring particularly to FIGS. 4 and 5, the stationary forming part 40 is shown provided with a fluid or air motor 43 that is positioned therein and whose piston rod 44 extends forwardly therefrom and is secured at its end to the cooperating, opposite, adjustable forming part 41. The adjustable part 41, as shown particularly in FIG. 5, has a pair of side sleeves or ears 42 which are adapted to slidably ride on a spaced-apart pair of guide rods 38 that extend along the right-hand part of the supporting frame or table 30. An intermediately positioned, cross-extending, spacer and stop block 45 projects upwardly from the frame or table 30 to limit the maximum inward movement of the part 41 on the guide rods 38, and a transversely extending, outer end piece 46 serves as a stop for limiting the maximum outward expanding movement of the part 41.

To conserve and concentrate the hot fluid, the frame 30 has a closing-off top plate or wall portion 35 extending about the fixed forming part 40, and a pair of side-extending, end-positioned, closing-off plate portions 36 that extend along and above the rods 38 to define a centrally open area 37 along the extent of the adjustable movement of the adjustable part 41. As a result, and due to the flexible coverage of the upper edge portion 51 of the sealing-off bag F, the open portion 37 will be substantially closed-off from the ambient atmosphere along the outer sides of the part 41, and its innermost portion will be open to the spacing between the parts 40 and 41 and thus, to the inside of a cap that is positioned in a stretched relation thereon.

The fluid motor 43 is connected at its opposite ends to a pair of flexible air tubings or lines **47*a* and 47*b* (see FIGS. 3 to 5), which alternately or selectively serve as positive pressure flow lines for motor-operating fluid or air supplied from a conventional motor-driven air compressor unit (not shown), as controlled by a three-way electric solenoid-operated valve 48. The valve 48 may be electrically controlled by a three-position foot pedestal switch 49**.

When a cap is first positioned on the pair of forming parts 40 and 41, they are in a closed or inner position with respect to each other (see FIG. 4). After a cap is received on the pair of forming parts 40, 41, the valve 48 is then actuated by depressing the foot pedal switch 49 to supply a positive flow of air under pressure to the left end of the motor through line **47*a* and provide a return or exhaust flow through the line 47*b* to stretch the cap between the parts 40 and 41. Then, the switch 49 may again be actuated to close-off flow of air and retain the expanded relation while the cap is being finished. Thereafter, the switch 49 may be moved to move the valve 48 to its sequential third position to reverse the direction of flow through the lines 47*a* and 47*b* and thereby move the piston rod 44 inwardly to move the part 41 towards the part 40** and release the finished cap.

The frame 30 is carried by a central column or post 25 which extends in an upright manner and, at its lower end, is mounted within a hub or collar **26*b* of the rim part 26 (see particularly in FIGS. 6 and 7). The hub or collar 26*b* is supported centrally of the rim or flange part 26 by cross-extending spokes 26*b*. A rivet pin or set screw 28 may be employed for fixing the shaft 25 in position within the hub 26*b*. The upper end of the shaft 25 fits within a pair of stepped mounting collars or hub portions 31 and 32 by means of pins or set screws 28. The collars 31 and 32 form an integral central support for the frame 30. With reference to FIG. 4, it will be noted that the column 25 may be braced by a diagonally extending member 27 which, at its upper end is secured as by rivets, to the post 25 and at its lower end is secured to the rim 26**.

With particular reference to FIGS. 2, 2A and 3, the steam pipe or tubular assembly E is carried on the post 25 to extend upwardly therealong in a central relation within the chamber C. This assembly is shown provided with a group of four, series or continuously connected, inner pipe or tubing members 20, 20', 20'', and 20''' which constitute a set (represented as 20) through which a continuous flow of heat-supplying steam may be attained, to not only heat the chamber C but also the chambers defined along spacing between outer sides of the members of the 20 set and inner sides of a second set 21 that has a cooperating series or group of outer pipe or tubing members represented as 21, 21', 21'' and 21'''.

Lower quality, less-dry, heat-supplying steam is supplied from a source, as indicated by the arrow of FIG. 3, through an input line 15 and a separator G to the inner pipe set 20 from a lower or wet area of the separator through piping **15*a*. Steam that has given-up heat during its series movement through pipes of the set 20 is then exhausted or fed into a return flow line 17 which is connected to an inlet end of heat exchanger 12. As shown, the heat exchanger 12 is mounted centrally and in an upwardly spaced position within the base part A to heat a pressurized flow of air, as indicated by the arrows a and b before it is passed upwardly into the mixing chamber C. Steam leaves the heat exchanger 12 through outlet 18 (see FIGS. 2 and 3**) and may then be returned to a suitable steam source, such as a boiler (not shown) for reheating and re-use.

The second or outer set 21 of pipe or tubing members extends in a spaced, paired relation along the inner pipe or tubing members of the set 20 to define a heating chamber therebetween and provide a dry steam receiving chamber from which steam may be periodically directly supplied to the mixing chamber C as bursts. As shown in FIGS. 1 and 3, dry steam from the upper portion of the separator G flows through control valve 16 and line **15*b* into direct, supplying piping system represented by the set of pipe or tubing members 21. Since the steam thus supplied is applied substantially uniformly in a circular area within the chamber C, it mixes with the heated air that is rising from the base A, and is then introduced to the inside of a cap that is being finished, primarily through the bottom open ends of the cap-receiving pair of forming parts 40 and 41** and out through the perforations or holes in their top and side wall portions.

FIG. 1 of the Bailey U.S. Pat. No. 3,883,051 shows a suitable inside-mounted electric motor and air blower assembly (represented as 10 in my FIG. 4) that may be mounted in the chamber of the housing B.

I claim:

1. In a finishing machine for a head covering in the nature of a cap or the like having an air chamber defining support base, a central post extending upwardly from and supported on the base, and an upper platform mounted on the post; wherein the platform has a through-extending central open portion, the support base has a heat exchanger across its chamber for heating air therewithin and has an upper open mouth portion, and means is cooperatively positioned with respect to the support base for drawing air through the heat exchanger and thereafter positively moving heated air upwardly and discharging it from the upper open mouth portion of the support base, the improvement which comprises: a non-permeable enclosing bag extending upwardly from and positioned between the support base and the platform in a chamber-defining relation about the central post, said bag having an open lower end portion adapted to fit about the upper open mouth portion of the support base and having an open upper end portion adapted to fit about the central open portion of the platform, a separator for separating steam being supplied into fully dry steam and lower quality less-dry heat-supplying steam, an upright tubular assembly mounted along the post and provided with a series-connected group of inner tubes through which the lower quality steam is continuously moved from said separator and thereafter supplied to the heat exchanger for heating air within the chamber of the support base before its introduction into the chamber defined by said bag, said tubular assembly having a group of perforated tubes positioned in an outwardly spaced relation along said inner tubes for receiving bursts of the fully dry steam from said separator and directly introducing dry steam centrally into and along the chamber of said bag, a pair of horizontally adjustable cap-receiving and forming parts of hollow perforated wall construction positioned on the upper platform above its central open portion to receive heated air and dry steam from said open upper end of said bag for their direct introduction into the interior of a cap positioned on said forming parts, and means for relatively moving said forming parts on the platform inwardly and outwardly on a substantially plane with respect to each other to enable receiving and stretching the cap to be finished thereon.

2. A finishing machine as defined in claim 1 wherein motor means is operatively positioned within one of said forming parts and is connected to the other forming part for moving it towards and away from said one forming part.

3. A finishing machine as defined in claim 2 wherein, said motor means is a fluid motor and fluid inlet and exhaust lines extend from said motor downwardly through the chamber of said bag and out adjacent a lower end portion thereof, and valve means is connected to the lower end of said fluid lines for alternately supplying positive fluid pressure to opposite ends of said fluid motor for actuating it inwardly and outwardly in a reciprocating manner.

4. A finishing machine as defined in claim 1 wherein, said open upper end portion of said bag extends above the platform into substantial closing-off engagement about said pair of forming parts, a rim flange extends about the upper open end portion of the support base, and said open lower end portion of said bag has a portion thereabout for tightly fitting it on said rim flange.

5. A finishing machine as defined in claim 1 wherein, a pair of spaced-apart guide members extend along said platform and through opposite sides of one of said pair of forming parts for guiding it in movement with respect to the other forming part, and said means for relatively moving said forming parts is a fluid motor carried within and by said other forming part, and said motor has a piston rod connected to said one forming part.

* * * * *